United States Patent [19]

Kent et al.

[11] Patent Number: 4,516,267

[45] Date of Patent: May 7, 1985

[54] HANG BAG

[75] Inventors: Garnet J. Kent, Mississauga; John C. Wood, Milton, both of Canada

[73] Assignee: W. R. Grace & Co., Cryovac Div., Duncan, S.C.

[21] Appl. No.: 518,894

[22] Filed: Aug. 1, 1983

Related U.S. Application Data

[63] Continuation of Ser. No. 358,503, Mar. 15, 1982.

[51] Int. Cl.[3] ..... B65D 30/00

[52] U.S. Cl. ..... 383/22; 383/23; 383/8; 206/497; 206/806

[58] Field of Search ..... 206/497, 464, 484, 554, 206/806; 383/22, 25, 7, 8; 53/413

[56] References Cited

U.S. PATENT DOCUMENTS

| | | | |
|---|---|---|---|
| 2,158,697 | 5/1939 | Harrison | 229/52 AL |
| 2,236,681 | 4/1941 | Goldschmidt | 229/52 AL |
| 2,873,905 | 2/1959 | Denton | 383/22 |
| 3,384,293 | 5/1968 | Welles | 229/54 R |
| 3,452,922 | 7/1969 | Hart | 229/54 R |
| 3,557,516 | 1/1971 | Brandt | 206/497 |
| 3,741,253 | 6/1973 | Brax et al. | 428/520 |
| 3,930,578 | 1/1976 | Stein | 206/497 |
| 4,078,659 | 3/1978 | Rensner | 206/497 |
| 4,127,688 | 11/1978 | Bieler et al. | 206/497 |
| 4,178,401 | 12/1979 | Weinberg et al. | 206/497 |
| 4,276,330 | 6/1981 | Stanley et al. | 206/484 |
| 4,296,861 | 10/1981 | Barrash | 229/52 AL |
| 4,352,844 | 10/1982 | Bornstein | 229/87 F |

FOREIGN PATENT DOCUMENTS

| | | | |
|---|---|---|---|
| 109119 | 9/1967 | Denmark | 229/54 R |
| 377631 | 6/1964 | Switzerland | 383/25 |
| 1341838 | 12/1973 | United Kingdom | 229/54 R |

*Primary Examiner*—Joseph Man-Fu Moy
*Assistant Examiner*—David Fidei
*Attorney, Agent, or Firm*—John J. Toney; William D. Lee, Jr.; Mark B. Quatt

[57] ABSTRACT

This invention is a hang bag and the method for making it. The hang bag is designed to be hung on peg board displays at supermarkets and the bag comprises a non-shrinkable, heat sealable strap across the width of a side seal heat shrinkable bag. After the product has been put in the bag and the bag has been shrunk, the unshrunken strap forms a convenient loop for easy hanging.

1 Claim, 4 Drawing Figures

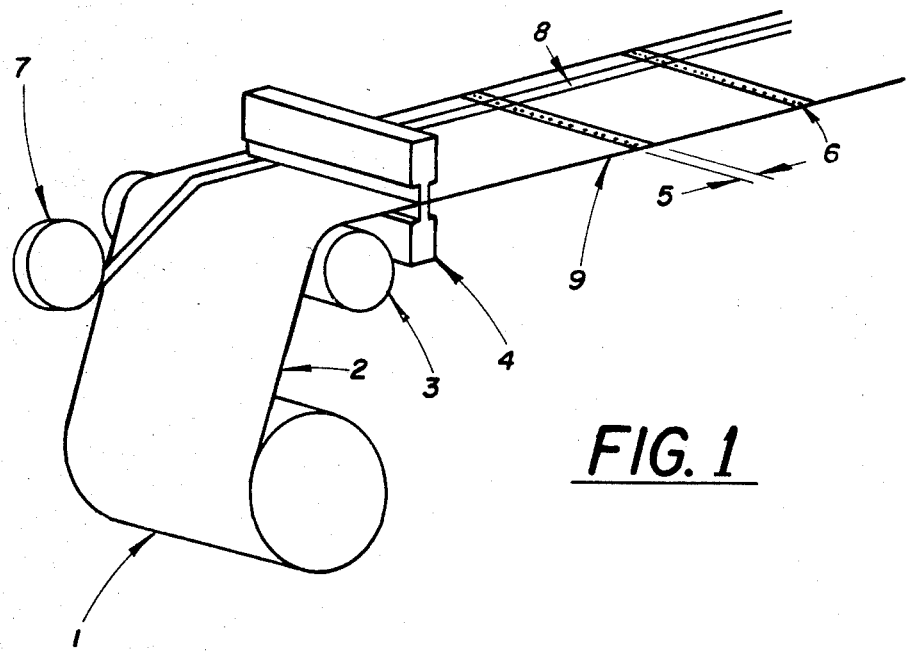
FIG. 1
FIG. 2
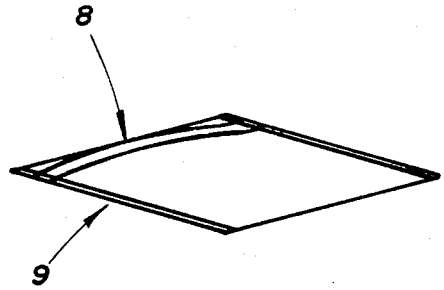
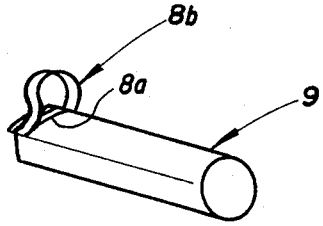
FIG. 3
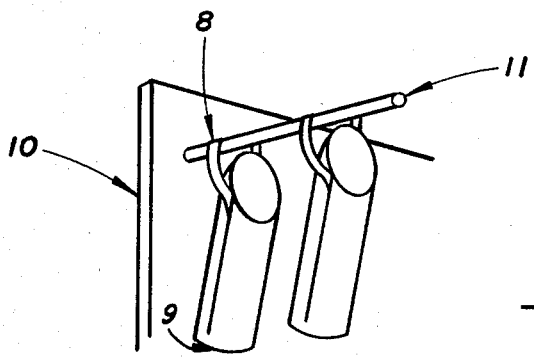
FIG. 4

HANG BAG

This is a continuation of application Ser. No. 358,503, filed Mar. 15,1982.

FIELD OF THE INVENTION

This invention relates to thermoplastic bags which may be filled and hung from a peg board display in a supermarket. More particularly, the invention relates to side-seal thermoplastic bags which are heat shrinkable and are used to package processed meat and cheeses which are displayed for retail sale.

BACKGROUND OF THE INVENTION

In retail grocery stores and supermarkets many of the processed meat and cheese pcakages are hung on peg boards for better display for the customer. In order to provide a hang up feature there are a number of alternatives to consider. Straps or hooks could be used which could be fixed to the finished package in a retail stores, e.g., a strip of semirigid plastic with a hook on one end; or, cut-outs of paper which can be shaped into a cone or a strap to hold a filled bag may be used. Another type of hang up feature consists of punching holes at either end of the bag and reinforcing the hole with metal or plastic eyelets in order to provide a sufficiently strong hanging means. Still another type of feature is a loop or strap sealed to a bag at the time the bag is made. It is this last feature with which this invention is concerned.

In the U.S. Pat. No. 3,207,300 which issued on Sept. 21, 1965 to H. L. Farmer, a labeled package is shown which contains semi-rigid articles with a wrapper of heat-sealable and heat-shrinkable plastics film surrounding the articles and a printed label strip of narrow width heat-sealable and shrinkable plastic film is disposed within the wrapper and extends transversely of the articles with the opposite ends of the strip respectively secured within heat seals. However, the strip shrinks with the wrapping and a loop is not left so that a hang strap is formed. Accordingly, it is one object of the present invention to provide a package with a shrinkable wrapper and a non-shrunk strip or strap which can be used as a hanging feature.

For packaging many food products, especially fresh meats or processed meats it is quite desirable to use a wrapping material which has low oxygen permeability. One such material is described in U.S. Pat. No. 3,741,253 which issued to H. J. Brax it al on June 26, 1973. In the Brax et al patent a packaging film having a first layer of a crosslinked ethylene vinyl acetate copolymer is described which is extrusion coated with a layer of a vinylidene chloride copolymer which in turn is extrusion coated with another layer of ethylene vinyl acetate copolymer. In using a bag which is made from film according to the Brax et al patent if the strap is sealed to the non-crosslinked vinyl acetate polymer layer, it was found that grease would attack the strap seals and the seal would fail at either instantly or either a short time after a filled bag was hung by the strap. Accordingly, it is another object of the present invention to provide a hang bag which is useable with a grease containing product and which will hang at retail display for an extended period of time.

The foregoing and other objects will be better understood with reference to the summary of the invention, the drawings, and the detailed description which follows.

SUMMARY OF THE INVENTION

In one aspect, the present invention is a hang bag which comprises a bag portion which includes front and back panels of multi-layer, heat shrinkable, thermoplastic sheet material wherein at least two layers of the multi-layer material have been coextruded, said panels comprising a single sheet folded so that the fold comprises the bottom of the bag, the edges on each side of said panels being sealed to the respective opposite side edge in parallel side seals leaving an unsealed side defining the top of the bag with an opening for loading the product into the bag; and, a strap of non-heat shrinkable, heat-sealable material, one end of said strap being sealed to one side seal and the other end to the other side seal whereby when the bag is heated and shrunken it shrinks away from the strap forming the strap into a loop for hanging the bag.

In another aspect, the invention is a hang bag wherein it is not necessary that two layers of the mult-layer film be coextruded but it is necessary that the strap comprise superimposed strips of heat-shrinkable and non-shrinkable material, the shrinkable strip being next to or in contact with the bag.

In still another aspect, the present invention is a package for hanging display comprising a product, a multi-layer, side-seal, thermoplastic bag shrunken about the product, the material from which said bag is constructed comprising a multi-layer film in which at least two layers of the film have been coextruded, and a hang loop comprising a non-heat-shrinkable strap of heat-sealable thermoplastic material, one end of said strap being sealed at one of the side seals to the outer surface of one layer of said coextruded material and the other end of the strap being sealed at the other side seal to the outer surface of one of the coextruded layers.

In still another aspect, the present invention is a method of making a hang bag which comprises providing a flattened, heat-shrinkable thermoplastic tubing wherein the material from which the tubing is made is multi-layer and the layer comprising the outside surface of the tubing has been coextruded with its adjacent layer, slitting the flattened tubing at or adjacent to one longitudinal edge, superimposing a strip of non-shrinkable material over said tubing, passing said tubing and said superimposed strip through sealing and perforating means which are arranged to make two successive transverse seals with perforations therebetween at spaced apart intervals along the length of said tubing parallel to each other; sealing said flattened tubing to itself and to said strip with the sealing means to form a side seal bag with the strip sealed in the respective side seals with perforations between the seals; and, separating the bags from each other along the perforations to form side seal bags.

DESCRIPTION OF THE DRAWINGS

The invention may be better understood with reference to the accompanying drawings in which:

FIG. 1 is a schematic representation of the process of tubing and strap material being made into a side-seal hang bag;

FIG. 2 is a perspective representation of unfilled, unshrunk hang bag according to the present invention;

FIG. 3 is a representation of a filled and shrunken bag according to the present invention showing the unshrunk hang loop; and, FIG. 4 is a representation of packages according to the present invention being displayed on a peg board at a retail supermarket.

DETAILED DESCRIPTION

Turning now to FIG. 1, roll 1 of flattened tubing 2 is shown being guided over guide roll 3 and through sealing and perforating means 4. The flattened tubing is preferably made from multi-layer, thermoplastic film having low oxygen permeability and one such film is described in the above mentioned Brax et al patent. Another preferred film is one in which a substrate layer of ethylene vinyl acetate copolymer containing approximately 9% vinyl acetate is extruded and crosslinked by irradiation and is subsequently extrusion coated with two coextruded layers. The two coextruded layers being molten and being extruded onto the substrate at the same time is, in effect, very much the same as extrusion coating with one layer. The two coextruded layers that make up the extrusion coating are a vinylidene cholride coplymer layer of the type disclosed in the Brax et al patent and a layer of ethylene vinyl acetate copolymer having approximately 9% vinyl acetate. The vinylidene chloride copolymer layer contacts the substrate and the ethylene vinyl acetate copolymer layer is on the outside. Thus, again considering FIG. 1, the outside surface of the flattened tubing 2 comprise uncrosslinked ethylene vinyl acetate copolymer and the inner surfaces of the tubing which are in contact with each other comprise crosslinked ethylene vinyl acetate copolymer. This tubing is preferably slit at the side edge opposite that where strip 8 is being applied from roll 7 and the slit edge, of course, will provide the mouth or openings to the completed bag. Slitting apparatus are well known in the art and are not shown.

As the slit tubing enters the sealing apparatus the strip of strap material 8 has been laid on top of the tubing. This strap material 8 is preferably made from low density polyethylene or from ethylene vinyl acetate copolymer and has not been oriented or stretched to render it heat-shrinkable to any appreciable extent. It must, of course, be a thermoplastic material which is heat-sealable and can be sealed with the tubing material in the sealing means 4. A typical width of this strap material is 25 mm. or about one inch.

The width of the flattened tubing will vary according to the product to be packaged in the finished side seal bag but a typical width of the flattened tubing is 10 to 12 inches or 25 to 30 centimeters.

The sealing means 4 can be any commercial seal and sever apparatus. These are well known in the art and typically would comprise an electrically resistant wire which when given a pulse of electric currant will be heated to a sealing temperature as the opposed members of sealing means 4 press together upon the tubing through strap 7. The sealing means 4 actually has two sealing wires to form spaced apart seals 5 and, in addition, the sealing means has perforation means to punch perforations 6 into the flattened tubing 2 and strap 8. The perforations are typically $2\frac{1}{2}$ to 3" apart and the dwell time when the sealing members close to form the side seals will be in the order of $\frac{1}{4}$ to $\frac{1}{2}$ second. In FIG. 1 after the sealing and perforating has been accomplished a flattened side seal bag 9 results which is still attached to the trailing bags which are being made by the sealing means 4. A side seal bag is generally considered to be one in which at least one side is closed by a seal and the bottom is formed by a fold.

Turning to FIG. 2, bag 9 has now been separated from the tubing and is ready to be filled. Filling can be manual or can be accomplished by any number of means, and a great variety of products, particularly food products such as meat and cheese can be inserted in the mouth of the bag which is at the end opposite strap 8. In the typical example being described herein, a 500 gram chub of process meat such as sausage is placed in the bag, the bag evacuated by any number of means well known in the art such as vacuum chamber means or vacuum nozzle means and the mouth of the bag is heat sealed. One suitable machine is the Model 8300 rotary vacuum machine sold by the Cryovac Division of W. R. Grace & Co. of Duncan, S.C., U.S.A. A heat seal similar to that applied by the impulse sealing means 4 can be used or a metal clip can be applied. After the final closure seal has been applied, the filled bag is placed briefly in water heated in the range of 185° to 205° F. to shrink the unsealed bag 9 tightly around the meat chub so that the package has the appearance shown in FIG. 3 where the bag 9 has shrunk and the strap material 8 has not thereby leaving loop 8 for hanging purposes.

In FIG. 4 a display pegboard 10 common to many supermarkets is shown having a peg 11 from which filled bags or packages 9 are hung by loop 8.

It was discovered that when a single layer strap was applied to multi-layer bag material which had not been coextruded that grease from the packaged product would attack the strap seals at elevated temperatures, such as the heat shrink temperature, and would cause the outer ply of the bag to delaminate.

It was surprisingly discovered that the delamination problem could be solved by coextruding at least two other layers of the multi-layer film from which the bag is made, one of these layers being the layer to which the ends of the strap 8 are heat sealed.

In a test to determine the reliability of the hang loop of this invention, peanut oil was applied to the inside of bags before packaging meat and then the bag was hung by the loop at 32° C. The non coextruded bag structures were found to fail either instantly or only after a very short time when subjected to this test with a 500 gram product. On the other hand, bags with the coextruded structure containg 500 grams of meat chub therein were hung from the strap both at chiller temperatures (8° C.) and at room temperature. No failures were discovered in hanging trials lasting up to 30 days.

In addition to discovering that the coextruded structure surprisingly solved the strap failure problem it was found that if a relatively wide band, approximately 2" wide, of heart shrinkable film such as heat shrinkable polyethlene was applied to one side of the tubing and then the unshrinkable strap was sealed on top of the shrinkable film that a successful hang bag would result. It was theorized that the wide band of shrinkable film which shrinks with the tubing from which the bag is made distributes the forces in the strap over a longer length of the outer ply of the bag material. This type of construction can be made as shown in FIG. 1 by applying a two layer strip of strap material 8 from a roll 7 wherein the first layer is a thermoplastic heat shrinkable material 8*a* and the second layer superimposed over the first is a nonshrinkable material 8*b* which will be the hang loop. As described herein above the two layer strap material 8 would be applied in the same fashion as the single layer but when shrunk the shrinkable ply or layer shrinks with the bag material and the non shrinkable material does not thus forming the hang loop as before. The width of the hang loop will be about 25 mm as before and the width of the shrinkable film will be about 2 inches or about 5 cm.

As mentioned above, one of the principal objects of the present invention is to provide a hang bag in which the material is both heat shrinkable and is one which has low gas permeability. Hydrolyzed ethylene-vinyl acetate copolymer when used as a layer in a multi-layer film provides excellent resistance to gas transmission, and, in the Brax et al patent it is stated that vinylidene chloride copolymers provide excellent resistance to the transmission of oxygen and other gases but that monolayer films of vinylidene chloride copolymers do not have the abuse resistance necessary to stand up to commercial distribution practices. Thus, the Brax et al patent discloses the discovery of a multi-layer film which includes a layer of vinylidene chloride copolymer in a unique combination of heat shrinkable, abuse resistant materials; and, in the present invention, it is desirable to use such a multi-layer film as disclosed in Brax et al, but the application of strap material to such s multi-layer film in a high speed bagmaking process resulted in an unacceptable failure rate when products containing grease were packaged in the bags and shrunk at elevated temperatures. The solution to this problem, which can be expected to occur in other multi-layer films used to package grease containing foods, e.g., fresh meat, smoked, cured and process meats and cheese, has been described above and is summarized in the claims below in which:

We claim:

1. A hang bag comprising:

(a) a bag portion including:

(i) front and back panels of heat shrinkable, thermoplastic sheet material;

(ii) said panels comprising a single sheet folded so that the fold comprises the bottom of the bag and, (iii) each side of said front and back panels being sealed to the corresponding side of the panels along their side edges in parallel side seals leaving the top side unsealed thereby defining the mouth of the bag for loading a product into the bag; and, (b) a single strap of non-heat shrinkable, sealable material, one end of said strap being sealed to one side seal and the other end to the other side seal;

(c) a heat shrinkable strap each end of which is sealed in an opposite side seal of said bag, said strap being shrunken with said bag, said non-heat shrinkable strap of thermoplastic material being superimposed over said shrinkable strap, one end of said strap being sealed to one side seal and the other end of said strap to the other side seal thus providing a hang loop for said bag, the respective ends of said non-shrinkable strap and said shrinkable strap being sealed together at a side seal, whereby when said bag is heated and shrunk the heat shrinkable strap shrinks with the bag and remains in contact therewith, said shrinkable bag and strap shrinking away from the non-shrinkable strap which remains unshrunken and provides a hang loop.

* * * * *